US007637129B2

(12) United States Patent
Wang

(10) Patent No.: US 7,637,129 B2
(45) Date of Patent: Dec. 29, 2009

(54) AIR JET PRESSURIZED CLOTHES WASHING MACHINE

(75) Inventor: Sheng-Ming Wang, 1580 MacChesney Dr., Tarpon Springs, FL (US) 34689

(73) Assignee: Sheng-Ming Wang, Tarpon Springs, FL (US)

( * ) Notice: Subject to any disclaimer, the term of this patent is extended or adjusted under 35 U.S.C. 154(b) by 306 days.

(21) Appl. No.: 11/973,255

(22) Filed: Oct. 4, 2007

(65) Prior Publication Data

US 2009/0090138 A1 Apr. 9, 2009

(51) Int. Cl.
*D06F 17/12* (2006.01)

(52) U.S. Cl. ..... 68/183; 134/102.2

(58) Field of Classification Search ..... 68/183, 68/184; 134/102.1, 102.2
See application file for complete search history.

(56) References Cited

U.S. PATENT DOCUMENTS

| | | | | | |
|---|---|---|---|---|---|
| 655,717 | A | * | 8/1900 | Kuppelmann | 68/181 R |
| 1,382,992 | A | * | 6/1921 | Lombard | 68/184 |
| 1,422,547 | A | * | 7/1922 | Doman | 68/184 |
| 1,474,277 | A | * | 11/1923 | Martel et al. | 68/184 |
| 1,651,191 | A | * | 11/1927 | Davis | 139/213 |
| 1,790,902 | A | * | 2/1931 | Cowles | 68/184 |
| 1,832,560 | A | * | 11/1931 | Kendig | 8/137 |
| 1,878,825 | A | * | 9/1932 | Caise | 68/184 |
| 2,270,805 | A | * | 1/1942 | Evans | 68/15 |
| 2,431,246 | A | * | 11/1947 | Hallanan | 68/207 |
| 2,529,802 | A | * | 11/1950 | Glass | 68/183 |
| 2,553,581 | A | * | 5/1951 | Hatfield | 68/12.14 |
| 2,575,039 | A | * | 11/1951 | Barnes | 68/148 |
| 2,649,706 | A | * | 8/1953 | Kemp | 68/184 |
| 2,669,240 | A | * | 2/1954 | Thorson | 134/95.3 |
| 2,969,665 | A | * | 1/1961 | Saverio | 68/184 |
| 3,102,153 | A | * | 8/1963 | Munch et al. | 266/180 |
| 3,293,890 | A | * | 12/1966 | Valdespino et al. | 68/21 |
| 3,418,832 | A | * | 12/1968 | Valdespino | 68/183 |
| 5,503,115 | A | * | 4/1996 | Franzke et al. | 122/390 |
| 5,522,941 | A | * | 6/1996 | Uchinami et al. | 134/37 |
| 5,590,551 | A | * | 1/1997 | Hong | 68/183 |
| 5,651,276 | A | * | 7/1997 | Purer et al. | 68/5 C |
| 6,289,530 | B1 | * | 9/2001 | Miller et al. | 4/619 |
| 6,346,126 | B1 | * | 2/2002 | Chao et al. | 8/149.2 |
| 2006/0201541 | A1 | * | 9/2006 | Ohnuma et al. | 134/148 |

FOREIGN PATENT DOCUMENTS

| | | | |
|---|---|---|---|
| DE | 10064 548 | * | 6/2002 |
| JP | 54-127157 | * | 10/1979 |
| JP | 60-055996 | * | 4/1985 |
| JP | 60-111690 | * | 6/1985 |
| JP | 08-117475 | * | 5/1996 |
| SU | 1640245 | * | 4/1991 |

* cited by examiner

*Primary Examiner*—Frankie L Stinson
(74) *Attorney, Agent, or Firm*—Donald W. Meeker

(57) ABSTRACT

A washing machine having high pressure angled air jets that introduce air into the wash water in a stationary pressurized tub. A circular swirl flow-pattern and air pressure within the warm wash water agitates and cleans the clothes without the need for a mechanically rotated drum or detergent. Sediment from the laundry is removed from the water by drains both at the top and the bottom of the tub. At the end of the wash cycle, the high pressure air is used to drain and dehydrate the clean clothes.

6 Claims, 3 Drawing Sheets

AIR JET PRESSURIZED CLOTHES WASHING MACHINE

CROSS-REFERENCE TO RELATED APPLICATIONS

Not Applicable.

STATEMENT REGARDING FEDERALLY SPONSORED RESEARCH OR DEVELOPMENT

Not Applicable.

THE NAMES OF THE PARTIES TO A JOINT RESEARCH OR DEVELOPMENT

Not Applicable.

BACKGROUND OF THE INVENTION

1. Field of the Invention

The present invention relates to clothes washing machines and particularly to a washing machine having high pressure angled air jets that introduce air into the wash water in a stationary tub to establish a circular swirl flow-pattern within the wash water to agitate and clean the clothes without the need for a mechanically rotated drum, and sediment from the laundry is removed from the water by drains both at the top and the bottom of the washing machine; at the end of the wash cycle the high pressure air is used to drain and dehydrate the clean clothes.

2. Description of Related Art including information disclosed under 37 CFR 1.97 and 1.98

During operation, a conventional clothes washing machine proceeds through a series of wash and rinse cycles requiring a substantial amount of time and detergents and other cleaning products to get clothes clean. Each rinse cycle includes a spin cycle portion wherein a clothes article containing tub is spun at a very high speed in order to extract water from the clothes. A drain pump is typically run during the spin cycle in order to remove water from the washer.

Prior art washers present a host of problems. Tangling of garments is common with traditional washing through agitation made by a cylinder. Residue from the detergent and loose fabric in the garments is caused by tangling in prior art washers. Prior art washers produce off-balanced tumbling noise and even vibration and movement of the prior art washing machines from the prior art washer's spinning cycle. Floating particles are typically not removed by prior art washers.

U.S. Pat. No. 1,878,825, issued Sep. 20, 1932 to Caise, shows a washing machine which uses submerged laterally mounted water jet nozzles to agitate the garments in a vertical axis.

U.S. Pat. No. 2,649,706, issued Aug. 25, 1953 to Kemp, describes a washing machine in which the clothes are agitated and washed using jets of water. The jets are arranged in the wall of the tub so as to cause a swirling effect in the cleaning water.

U.S. Pat. No. 1,790,902, issued Feb. 3, 1931 to Cowles, indicates a washing machine with agitation which is provided by a jet or jets of liquid.

Two U.S. Pat. Nos. 2,651,191 issued Sep. 8, 1953 and No. 2,575,039 issued Nov. 13, 1951 both to Barnes, are for a washing machine which uses air jets submerged in the cleansing liquid for agitating clothes and the cleansing liquid. U.S. Pat. No. 655,717, issued Aug. 14, 1900 to Kuppelmann, provides a machine generally used by brewers to wash fibrous or loose material which comprises a tank in which pulp is placed. Cold water and air are introduced into the tank through ports to cause the mass of pulp to whirl and thereby be agitated.

U.S. Pat. No. 3,293,890, issued Dec. 27, 1966 to Valdespino, shows an aspir-jet washer which uses aspirator nozzles to introduce air into the tank through ports to cause the garments and cleaning water to be agitated.

U.S. Pat. No. 3,418,832, issued Dec. 31, 1968 to Valdespino, claims a small portable apparatus connected to an external source of water under pressure which injects water and air from the atmosphere through a venture-type nozzle arranged generally tangentially of the apparatus.

U.S. Pat. No. 1,474,277, issued Nov. 13, 1923 to Martel, discloses a washing machine having a continuous whirling action of water which is imparted by streams of water forcibly delivered through apertures at varying elevations.

U.S. Pat. No. 2,529,802, issued Nov. 14, 1950 to Glass, puts forth a cleaning machine for dry or wet cleaning of garments which comprises an upstanding container having washing liquid therein which is agitated by compressed air which passes through a pipe that encircles the container, through risers up to and through lateral ports, thereby causing a swirling effect.

U.S. Pat. No. 2,270,805, issued Jan. 20, 1942 to Evans, concerns a washing machine which uses compressed air passing through laterally mounted and submerged jets in intermittent blasts to agitate the clothes in a clockwise or counterclockwise fashion.

What is needed is a jet-washer for washing clothes which uses a series of spaced and variously angled jets of air in a stationary sealed tank of water to swirl the water under pressure and clean clothes faster and better than prior art washing machines without the need for detergents, thereby eliminating problems caused by prior art washing machines.

BRIEF SUMMARY OF THE INVENTION

An object of the present invention is to provide a jet-washer for washing clothes which uses a series of spaced and variously angled jets of air in a stationary sealed tank of water to swirl the water under high pressure and clean clothes faster and better than prior art washing machines without the need for detergents, thereby eliminating problems caused by prior art washing machines.

In brief, a pressurized jet-washer has four air jets at four different levels and directions creating clockwise and spiral movement in the water to wash garments. Air jets force the non-dissolved particles and stains to be separated from the garments and float the particles to the top of the water in the bubbles made by the jets. The pressure in the wash tank is built up by the air jets and the temperature of warm wash water to increase the dissolving rate of water soluble particles. The jet-washer of the present invention washes garments by air jets, clockwise and spiral movement, pressure, and temperature.

The oxygen level is increased in the water by the air jets making the water "fresher" to control the bacteria growth.

There is no need for detergent, only spray stain remover and bleach might be needed for tough stains.

The jet-washer of the present invention reduces tangling of garments common with traditional washing through agitation made by a cylinder, and reduces the residue of detergent and loose fabric in the garments caused by tangling.

With the jet-washer of the present invention there is no more off-balanced tumbling noise from traditional washer's spinning cycle. The jet-washer of the present invention drains and dehydrates the garments by forcing water out of garments through pressurized air.

The traditional washer fails to remove floating particles. The new jet-washer has one drain for floating particles on top and another drain for the sediment at bottom.

With no detergent, less tangling, and less wash time, the jet-washer of the present invention prolongs the life and color of garments and saves energy and money.

BRIEF DESCRIPTION OF THE SEVERAL VIEWS OF THE DRAWINGS

These and other details of my invention will be described in connection with the accompanying drawings, which are furnished only by way of illustration and not in limitation of the invention, and in which drawings.

DETAILED DESCRIPTION OF THE INVENTION

Figure 1:
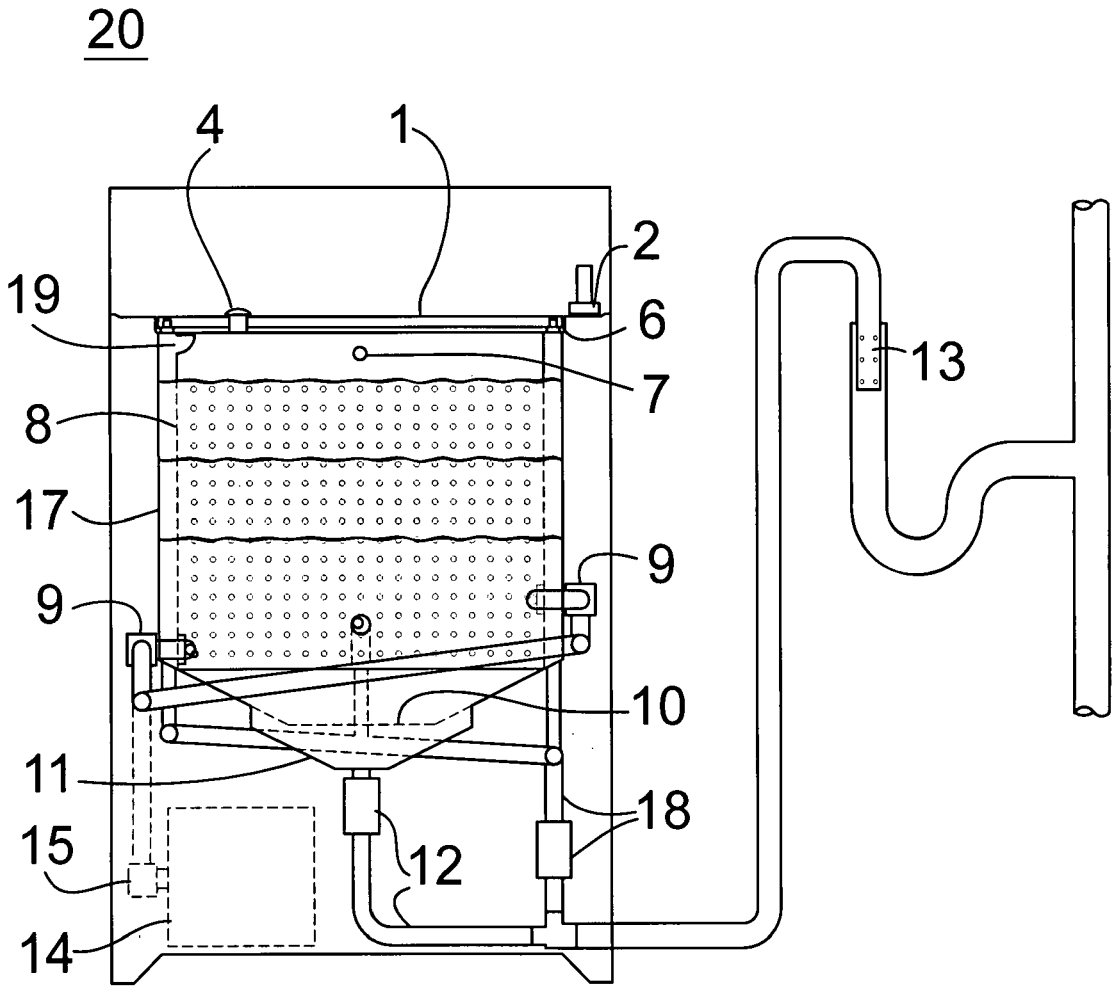
FIG. 1 is a diagrammatic side elevation partial cross-sectional view of the air jet pressurized washer of the present invention showing the perforated wall of the inner drum and the air jets and pump, the upper and lower drains, and the outer drain pipe.
Figure 2:
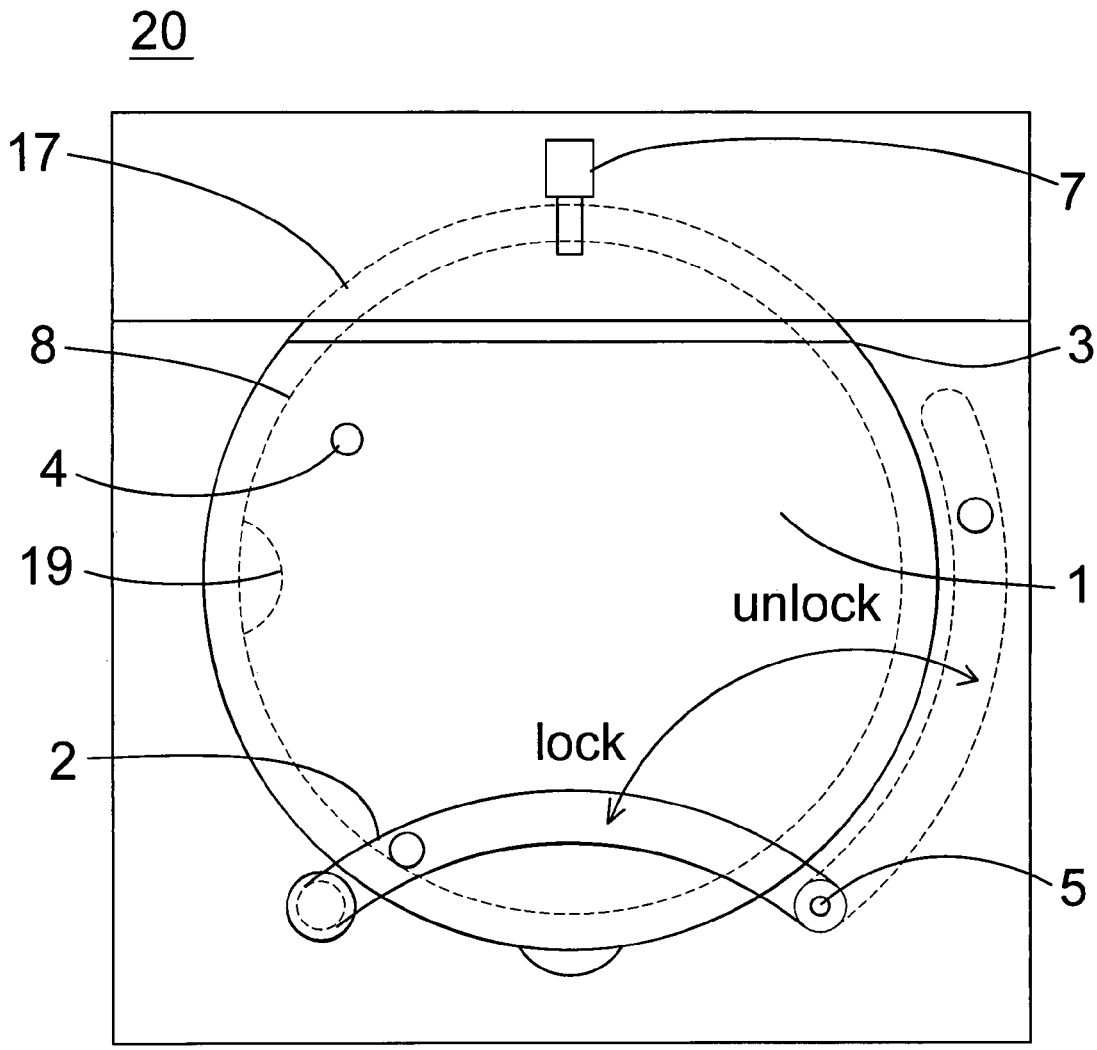
FIG. 2 is a top plan view of the air jet pressurized washer of FIG. 1 showing the air tight sealed steel lid and locking arm.
Figure 3:
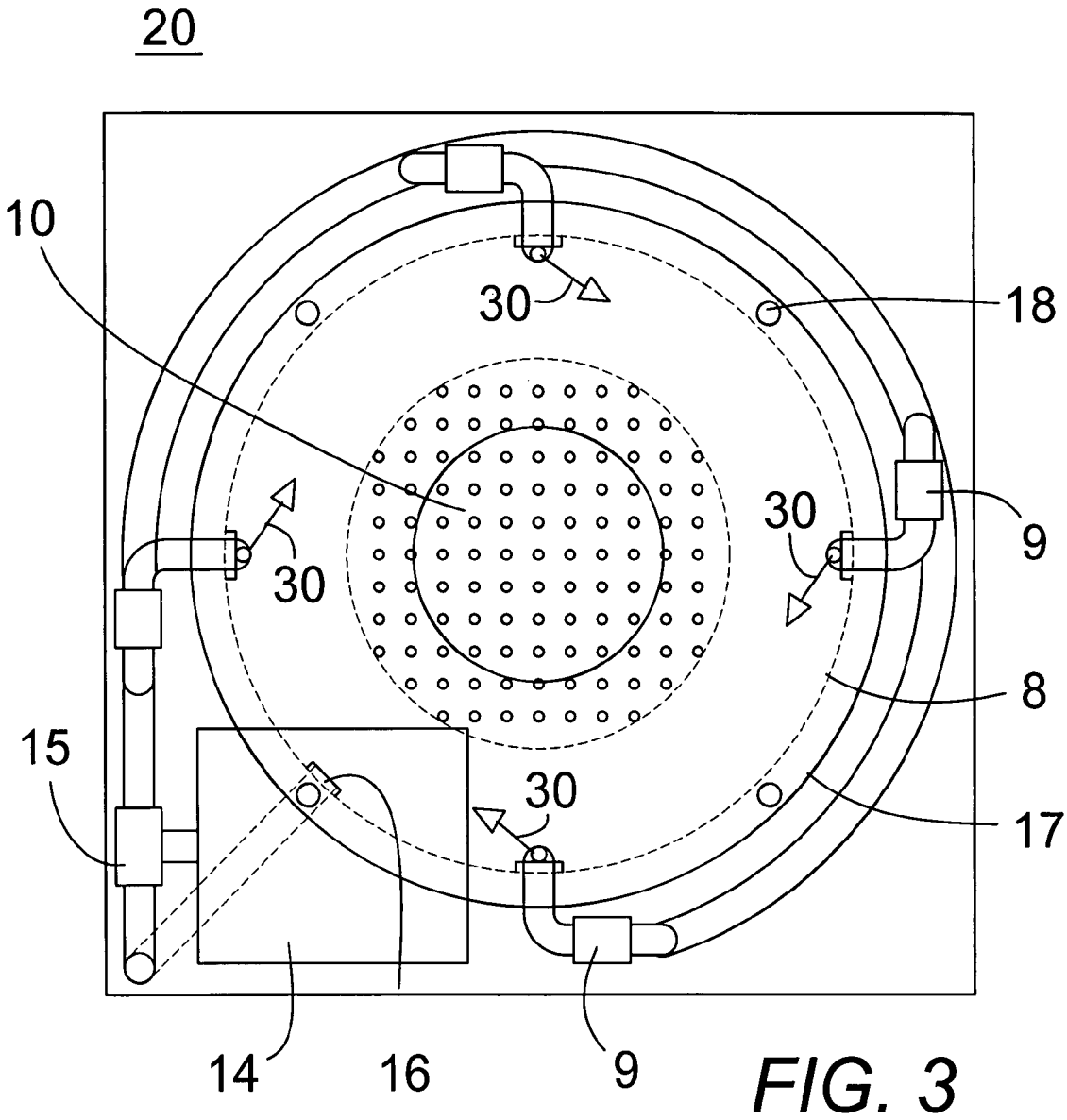
FIG. 3 is a diagrammatic top view in partial section of the air jet pressurized washer of FIG. 1 showing the air jets around the perimeter and the perforations on the bottom of the inner drum.

In FIGS. 1-3, the present air jet washing machine invention 20 comprises a vertical double cylindrical drum comprising a perforated stationary inner drum 8 and a solid stationary outer drum 17 having a circular top opening, a bottom drain 11 to drain water and substances settling in the water which substances were removed from the clothes, and a top drain 18 from the perforated walls of the inner drum for draining water and substances floating on the water which substances were removed from the clothes, an air tight steel lid 1 over the top opening with an annular rubber seal 6 and a pin hinge 3 on each side, a steel arm locking device 2 on a pivot hinge 5, a spring loaded air pressure balance device 4 to release air beyond designed pressure for safety, an air pump 14, a series air jet nozzles 9 protruding into the wash tank spaced apart around the interior cylindrical wall, each nozzle angled acutely vertically and horizontally away from the cylindrical wall so that air entering the pressurized wash tank through the series of air jet nozzles produces a swirling high velocity vortex motion in the water in the wash tank to agitate and clean the clothes in the water in the pressurized wash tank and to rinse and air dry the clothes with the water removed from the pressurized wash tank, the air jet nozzles each comprising a backflow prevention device to prevent water and air from escaping the pressurized wash tank. A warm/cold water inlet 7 with a backflow preventer fills the washer tank with a desired level of water for the size of the wash. Preferably there are four air jets 9 at four different levels and directions to create the clockwise and spiral swirling movement to wash the clothes. All these features pressurize the wash tank at higher pressure during washing cycle, and according to the laws of physics, the higher the pressure, the higher dissolving rate of soluble particles for cleaner clothes.

A drainpipe from the washer tank has a perforated end 13 of the drainpipe inserted into a drain trap below to relieve air pressure exiting the pressurized air tank from destroying the water prime in the drain trap during drain and dehydration cycles.

The inner tank 8 further comprises a perforated bottom 10 slanted toward the center of the tank to receive garments resting thereon during a dehydration cycle to assist in forcing the water from the damp garments by the air pressure into drain.

The present invention has an insulation blanket which wraps around the wash tank to prevent the heat lost of warm/hot water during washing & rinsing cycles, and according to the laws of physics, the higher the temperature, the higher dissolving rate of soluble particles. All prior art washers do not have insulation to retain the heat.

The present invention has a pressured air outlet 16 into wash tank above maximum washing water line, a lower tank drain with open-close solenoid 12, an air pump 14, and an outer tank drain with open-close solenoid 18. All these features pressurized the wash tank at higher atmospheric pressure during drain & dehydrate cycles, and it forces water out off garments into drain(s) at normal atmospheric pressure. Some washers of prior arts use "vacuum" function to suck out water from the drain side, but the "vacuum" fails to apply even suction pressure on all garments in the wash tank to remove water from the garment efficiently, but the present invention applies constant higher pressure onto every inch of the garments in the wash tank during the entire dehydration cycle which will efficiently "dry" or dehydrate the garments.

The present invention has an outer stationary tank drain with an open-close solenoid 18 which will open first during drain cycle to discharge floating particles at top of wash tank, following that a lower tank drain with open-close solenoid 12 will open to discharge sediments at bottom of wash tank. All prior art washers fail to remove floating particles by discharge water from holes at the bottom or/and sidewalls of wash tank linked to a drain.

The present invention has a preset washing water table level to be adequately higher than the selected wash load of garments (small, medium, high) and to insure the garments are freely moving in the washing liquid.

A pressured air inlet 16, as shown in FIG. 3, into the wash tank above the maximum washing water line increases the pressure in the wash tank and pushes particles/water into the drain trap during drain and dehydration cycles.

In use, during the wash cycle drop garments (spray stain remover as needed) into the washer tank 8 and add bleach into the softener and/or bleach filler & dispenser 19 if desired (no detergent required). Close the lid 1 and lock the pressure locking arm 2 and program the washing function, water level & push start. Fill the washer tank 8 with warm/cold water thru inlet 7 to desired water level and start the air pump 14 and solenoid switch 15 to open the air jet nozzles 9. The air jets 9 create a clockwise and spiral washing movement and pressurize the tank to the desired pressure. The air jets 9 create the swirling flow to separate particles from the garments and pressure and temperature increase the dissolving rates of the particles into the water. The air pump 14 runs for the programmed time of the wash load. During the drain cycle, which may be part of the wash or rinse cycles, the outer tank drain solenoid 18 opens first and the lower tank drain solenoid 12 opens later to drain particles and water and the air pump 14 runs and the solenoid 15 switch open to the air inlet 16 above the maximum washing water line to increase the pressure in the wash tank and push floating particles/water into the outer tank 17 and through the drain solenoid 18 to the drain trap. The air pressure in the wash tank pushes sediments/water into the lower drain 11 and through the drain solenoid 12 to the drain trap. Then, the two drain solenoids 12 and 18 switch to close per programmed time and the air pump 14 stops. Then, the rinse cycle, drain cycle and the dehydration cycle follows.

In the rinse cycle cold water is input through the inlet 7 to a programmed water level. The air pump 14 starts and the solenoid 15 switch is opened to the air jet nozzles 9. The air jets 9 create clockwise and spiral rinsing movements and pressurize the wash tank to the designed pressure. The air pump 14 runs per the programmed time of the rinse load. Then the drain cycle is repeated. In the dehydration cycle, the air pump 14 runs and the solenoid 15 switch stays opened to the air outlet 16 above the maximum washing water line.

When the pressure in the tank 8 builds up to a desired pressure at the programmed time, the lower tank solenoid 12 switch opens. Higher pressure at the top of tank than the lower tank suck outs the water from the piled damp garments downward into lower tank perforated drain 11 and pushes the pressed out water through the drain solenoid 12 to the drain trap. The lower tank drain solenoid 12 switches to close at the programmed time.

The rinse and drain and dehydration steps may be repeated depending upon the programmed wash load. The air pump 14 stops per the programmed time of the wash load and the remaining pressure is released through the air pump to the atmosphere to complete the programmed wash.

An emergency stop, if necessary, is made by pressing a stop button and during wash and rinse cycle, the air pump 14 stops and the solenoid 15 is switched open to the air outlet 16 to release the air pressure through the air pump to the atmosphere, and during the drain and dehydration cycle, the air pump 14 stops and the solenoid 15 is already open to the air outlet 16, which will reverse the air flow and release the air pressure through the air pump to the atmosphere. The locking arm 2 is unlocked, the steel lid 1 lifted to open the wash tank. Then the steel lid is closed the locking arm 2 locked, and a start button is pressed to resume the previous function.

It is understood that the preceding description is given merely by way of illustration and not in limitation of the invention and that various modifications may be made thereto without departing from the spirit of the invention as claimed.

What is claimed is:

1. An air jet pressurized washer device comprising:

a pressurized wash tank to retain water and clothes to be washed therein, the pressurized water tank comprising a vertical double cylindrical drum comprising a perforated stationary inner drum and a solid stationary outer drum having a circular top opening, a bottom drain to drain water and substances in the water which substances were removed from the clothes, and a top drain for draining water and substances floating on the water which substances were removed from the clothes;

a series of air jet nozzles fed with air under pressure from an air pump, the series of air jet nozzles protruding into the wash tank spaced apart around the interior cylindrical wall, each nozzle angled acutely vertically and horizontally away from the cylindrical wall so that air entering the pressurized wash tank through the series of air jet nozzles produces a swirling high velocity vortex motion in the water in the wash tank to agitate and clean the clothes in the water in the pressurized wash tank and to rinse and air dry the clothes with the water removed from the pressurized wash tank, the air jet nozzles each comprising a backflow prevention device to prevent water and air from escaping the pressurized wash tank;

a spring loaded air pressure balance device to balance the air pressure in the water tank to produce the desired pressure;

an air tight steel lid comprising a solid steel circular disc to cover the circular top opening in the pressurized wash tank, an air-tight seal between the lid and the circular top opening in the pressurized wash tank, a steel arm locking device to secure the steel lid on the pressurized wash tank;

thereby creating an air jet pressurized washer device having an interior pressure in the pressurized washer tank higher than outside atmospheric pressure, the higher pressure producing a higher dissolving rate of soluble particles and together with the swirling high velocity vortex motion in the water cleaning the clothes without a need for a cleaning detergent.

2. The device of claim 1 wherein the water in the pressurized tank is heated water added to the tank and further comprising an insulation blanket wrapped around the pressurized wash tank to prevent heat loss of heat from the heated water to create a dissolving rate of soluble particles in the heated water due to retention of heat which is higher than without retaining the heat.

3. The device of claim 1 further comprising a pressured air inlet communicating with the interior of the pressurized wash tank above the water and a lower tank drain communicating with a bottom of the pressurized wash tank to drain the bottom of the pressurized wash tank, the lower tank drain comprising an open-close solenoid, an air pump, and an outer tank drain with open-close solenoid to pressurize the pressurized the wash tank at a higher pressure than outside atmospheric pressure when draining the wash tank and dehydrating the clothes to apply constant higher pressure onto every inch of the clothes in the pressurized wash tank during an entire dehydration cycle to force water out of the clothes into the drains and substantially dry the clothes.

4. The device of claim 3 wherein the top drain comprises a top drain outlet and an open-close solenoid which opens first during a drain cycle to discharge substances floating on the water at a top of the pressurized wash tank, and the bottom drain comprises a bottom drain outlet and open-close solenoid which opens after the top rain to discharge substances in the water at bottom of the pressurized wash tank.

5. The device of claim 1 further comprising a drainpipe having a perforated end of the drainpipe inserted into a drain trap to relieve air pressure exiting the pressurized air tank from destroying the water prime in the drain trap during drain and dehydration cycles.

6. The device of claim 1 wherein the inner tank further comprises a perforated bottom slanted toward the center of the tank to receive garments resting thereon during a dehydration cycle to assist in forcing the water from the damp garments by the air pressure into drain.

* * * * *